US006127986A

United States Patent [19]

Wen et al.

[11] Patent Number: 6,127,986

[45] Date of Patent: Oct. 3, 2000

[54] INTEGRATED DOWN-CONVERTER WITH DIPOLE-ANTENNA IMPLEMENTED WITH NOVEL MECHANICAL FILTER STRUCTURE

[75] Inventors: Charles Wen; Feng-Jen Wang; Shun-Yu Chien, all of Hsinchu, Taiwan

[73] Assignee: Transystem, Inc.

[21] Appl. No.: 09/223,830

[22] Filed: Jan. 2, 1999

Related U.S. Application Data

[60] Provisional application No. 60/070,364, Jan. 2, 1998.

[51] Int. Cl.[7] ..... H01Q 9/16

[52] U.S. Cl. ..... 343/820; 343/821; 343/793; 455/293

[58] Field of Search ..... 343/820, 821, 343/822, 793, 840, 851, 852; 455/280, 288, 293, 333; H01Q 9/16, 19/13, 9/20

[56] References Cited

U.S. PATENT DOCUMENTS 5,523,768 6/1996 Hemmie et al. ..... 343/840
5,982,336 6/1996 Wen et al. ..... 343/793

*Primary Examiner*—Hoanganh Le
*Attorney, Agent, or Firm*—Bo-In Lin

[57] ABSTRACT

The present invention discloses an integrated dipole antenna and down converter apparatus. The integrated dipole antenna and down converter apparatus includes a dipole antenna for receiving microwave signals therein. The integrated dipole antenna and down converter apparatus further includes a down converter for receiving processed signals of the microwave signals from the dipole antenna for converting the processed signals to signals of lower frequency. The down converter includes main plate for supporting a tunable mechanical filter. The down converter further includes a tunable semi-mechanical filter supported on the plate. The semi-mechanical filter includes an upper circuit assembly and an identically symmetrical lower circuit assembly for canceling electromagnetic waves transmitting in the upper and lower circuit assemblies and the main plate whereby signal filtering efficiency is improved by reducing signal dissipation in the upper and lower circuit assemblies. In a preferred embodiment, the integrated dipole antenna and down converter apparatus further includes a housing for containing the down converter. The housing and the upper and lower circuit assemblies defining an upper and a lower space for storing energy of the electromagnetic waves therein thus reducing signal dissipation in the upper and lower circuit assemblies. In another preferred embodiment, the semi-mechanical filter further includes a capacitance tuning means, which includes a set of four screws. The capacitance tuning means further includes rubber tuning means and TEFLON spring means for allowing flexible adjustment of a distance from the upper circuit assembly and the bottom circuit assembly to the surface of the container housing.

21 Claims, 7 Drawing Sheets

INTEGRATED DOWN-CONVERTER WITH DIPOLE-ANTENNA IMPLEMENTED WITH NOVEL MECHANICAL FILTER STRUCTURE

This Application claimed a priority filing date of Jan. 2, 1998 benefited from a Provisional Application Ser. No. 60/070,364 filed on Jan. 2, 1998 by the same inventors of this Formal Application.

BACKGROUND OF THE INVENTION

1. Field of the Invention

This invention relates generally to the apparatus and method of a down converter for microwave signal transmission. More particularly, this invention relates to an improved antenna structure and method to design and manufacture a single body unit of downconverter integrated with a dipole antenna. The unit is provided with improved dipole structure and a novel semi-mechanical filter for application in a television signal reflector and antenna system to improve the reliability and filtering performance of the signal process.

2. Description of the Prior Art

For television signal transmission, several technical difficulties are faced in the application of a conventional down converter for typical semi-parabolic or dish-shaped antennas. The design involves a feed antenna integrated with a down converter. The down converter, which is integrated with a dipole antenna and implemented as part of the semi-parabolic antenna as a single operation unit is commonly installed on a roof top to operate in an outdoor environment. In order to insulate the dipole antenna and the down converter from water damages, special packaging material such as certain plastic container and fillers injected into a housing structure are required. The difficulties arise from the fact that the performance characteristics of the dipole antenna are often altered significantly during the filler injection process depending on various filler injection parameters. While the functional relationship between the performance characteristics and the parameters applied in the filler injection process are difficult to measure and control. A dipole antenna has to be designed and manufactured through several trial-and-error iterations before a dipole antenna with precise performance characteristics can be achieved and ready for packaging by employing a plastic injection process. Thus, the dipole antenna implemented with the plastic injection molding package are generally considered as inconvenient and expensive due to the requirement of applying this trial-and-error iterative manufacture process. In addition to the technical difficulties faced by those involved in manufacturing the dipole antenna, a mechanical filter implemented for down converter is not commonly used despite its excellent filtering performance. Similar to that of the dipole antenna, a fine-tuning of the filtering characteristics of a mechanical filter is often difficult to carry out with high precision as part of the manufacture processes. Like the dipole antenna packaged with plastic molding, a mechanical filter implemented for a down converter is also considered as expansive and inconvenient due to these difficulties.

Other than this high quality mechanical filter configuration, a down converter for semi-parabolic shaped antenna can also be manufactured on a printed circuit board (PCB), e.g., a FR4 PC board. One example of such a structure for build a down converter is disclosed in a U.S. Pat. No. 5,523,768, entitled "Integrated Feed and Down Converter Apparatus" by Hemmie et al. (issued on Jun. 4, 1996). An integrated semi-parabolic antenna/down converter multi-channel multi-point distribution system (MMDS) receiver is disclosed by Hemmie et al. which includes a support boom of a semi-parabolic antenna to contain the down converter electronics. Located at the focal area of the semi-parabolic antenna are a pair of driven feed elements which are directly connected to the printed circuit board carrying the down converter electronics. The down converter is formed in an elongated shape to fit entirely within the formed hollow interior of the support boom. The down converter comprises a first printed circuit board, which contains a RF filter located at the input end of the printed circuit board. The input to the RF filter circuit is directly connected to the pair of driven feed elements by soldering the legs of the driven feed elements directly to the input of the RF filter stage on the first printed circuit board. The RF filter is surrounded by an input ground shield, which covers the RF filter circuit. The shield is soldered to the top and bottom ground planes of the printed circuit board. At the opposite end of the printed circuit board is an output amplifier whose output is connected to a coax output lead. A coax ground shield engages the opposite end of the first printed circuit board in a perpendicular orientation so as to position the opposite and of the printed circuit board with the hollow interior.

While the printed circuit board (PCB) filters can be manufactured with simplified and automated procedures. The PCB filters provide the benefit of low cost implementation in the down converter. However, the PCB filters suffer from the disadvantages that energy transmission through the filters are impeded due to high dissipation over the PCB where large percents of signal energy are stored instead of transmitted through. The performance of signal filtering is also affected by temperature variations due to the fact that signal energy dissipation depends on the environmental temperature around the PCB. For these reasons, a PCB filter is not suitable for generating signals to be further processed by a low noise amplifier.

A different type of filter is manufactured by forming the filter on a ceramic substrate. Such a filter also suffers the same disadvantages as a PCB filter due to the fact that significant signal energy dissipation also incurs in the ceramic substrate. Again, the ceramic type of filters is not suitable for generating signals to be amplified by a low noise amplifier.

Therefore, a need still exists in the art of down converter for television signal transmission to provide a new structure and manufacture method to produce a new type down converter such that high quality low cost down conversion of the television signal can be achieved. It is desirable that a novel structure of a signal filter can be employed to provide the performance level of a mechanical filter in a down converter without requiring time consuming design and development efforts such that the manufacture cost of the down converter can be reduced. It is further desirable that such a down converter can provide high structural integrity suitable for reliable long-term outdoor operation.

SUMMARY OF THE PRESENT INVENTION

It is therefore an object of the present invention to provide a novel down converter structure and signal processing configuration combining a mechanical filter and a semi-mechanical filter. The performance characteristics of the down converter can be conveniently controlled in the manufacturing processes whereby the aforementioned difficulties and limitations in the prior art can be overcome.

Specifically, it is an object of the present invention to provide a novel down converter structure and signal processing configuration combining a mechanical filter and a semi-mechanical filter. Adjustment of the filtering characteristics of the mechanical and semi-mechanical filters can be conveniently carried out for fine tuning these filters whereby a timing consuming process by applying iterative trial-and-error manufacture procedures can be circumvented.

Another object of the present invention is to provide a novel down converter structure and signal processing configuration combining a mechanical filter and a semi-mechanical filter. A simplified housing assembly is provided to contain the mechanical and semi-mechanical filters therein with seamless body composed of casting aluminum sealed with a single leak proof lid such that total waterproof of the dipole antenna-down converter is assured to provide reliable long term outdoor operation.

Another object of the present invention is to provide a novel down converter structure and signal processing configuration combining a mechanical and a semi-mechanical filters by integrating the down converter with an improved dipole antenna and a balance-unbalance converter. The dipole antenna is manufactured with higher water resistivity and structural integrity while providing high bandwidth performance characteristics between a bandwidth ranging from 2 GHz to 3 GHz.

Another object of the present invention is to provide a novel down converter structure and signal processing configuration combining a mechanical filter and a semi-mechanical filter. Low signal dissipation is achieved and high stability of signal conversion is continuously performed such that a down converter of high efficiency and high stability manufactured with simplified procedures at lower cost than conventional down converter with mechanical filter is provided.

Another object of the present invention is to provide a novel down converter structure and signal processing configuration combining a mechanical filter and a semi-mechanical filter. The semi-mechanical filter is constructed with symmetrical structure including the circuits printed on both sides of the printed circuit board. The semi-mechanical filter performs as a true mechanical filter without being affected by the signal dissipation when transmitting in the printed circuit board and further the semi-mechanical filter is manufactured without requiring a soldering operation commonly employed in a conventional structure when a mechanical filter is employed.

Briefly, in a preferred embodiment, the present invention includes integrated dipole antenna and down converter apparatus. The integrated dipole antenna and down converter apparatus includes a dipole antenna for receiving microwave signals therein. The integrated dipole antenna and down converter apparatus further includes a down converter for receiving processed signals of the microwave signals from the dipole antenna for converting the processed signals to signals of lower frequency. The down converter includes main plate for supporting a tunable mechanical filter. The down converter further includes a tunable semi-mechanical filter supported on the plate. The semi-mechanical filter includes an upper circuit assembly and an identically symmetrical lower circuit assembly for canceling electromagnetic waves transmitting in the upper and lower circuit assemblies and the main plate whereby signal filtering efficiency is improved by reducing signal dissipation in the upper and lower circuit assemblies. In a preferred embodiment, the integrated dipole antenna and down converter apparatus further includes a housing for containing the down converter. The housing and the upper and lower circuit assemblies defining an upper and a lower space for storing energy of the electromagnetic waves therein thus reducing signal dissipation in the upper and lower circuit assemblies. In another preferred embodiment, the semi-mechanical filter further includes a capacitance tuning means, which includes a distance adjusting means, e.g., a set of four screws. The capacitance tuning means further includes rubber tuning means and TEFLON spring means for allowing flexible adjustment of a distance from the upper circuit assembly and the bottom circuit assembly to the surface of the container housing. Flexible tuning of the capacitance of the semi-mechanical filter can be achieved by adjusting the screws to adjust the distance between the top and bottom printed circuit boards and the seamless housing container.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
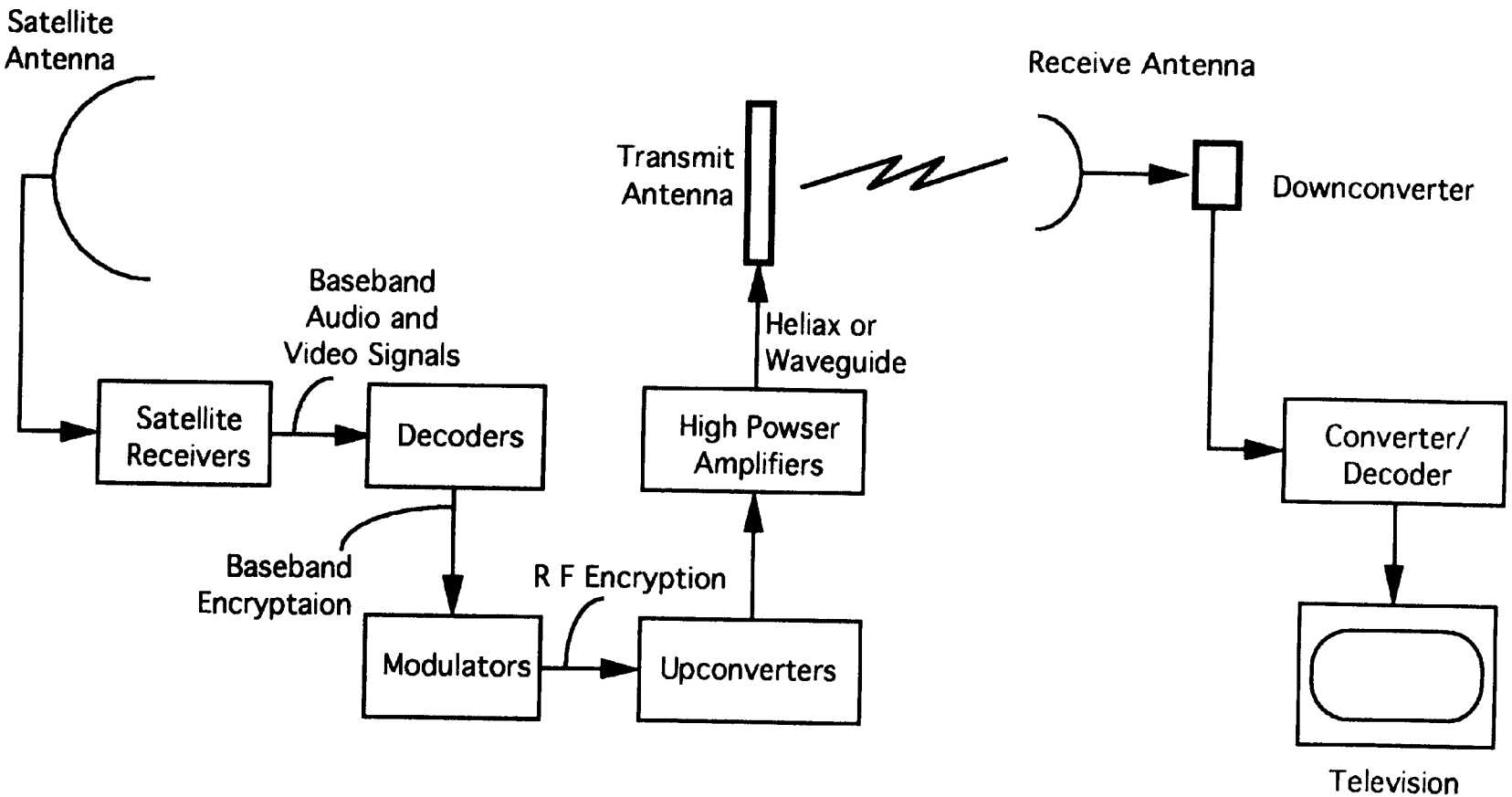
FIG. 1 is a functional diagram to illustrate the functions performed by various systems employed for television signal transmission including the integrated antenna-down converter system pertinent to this invention.
Figure 2:
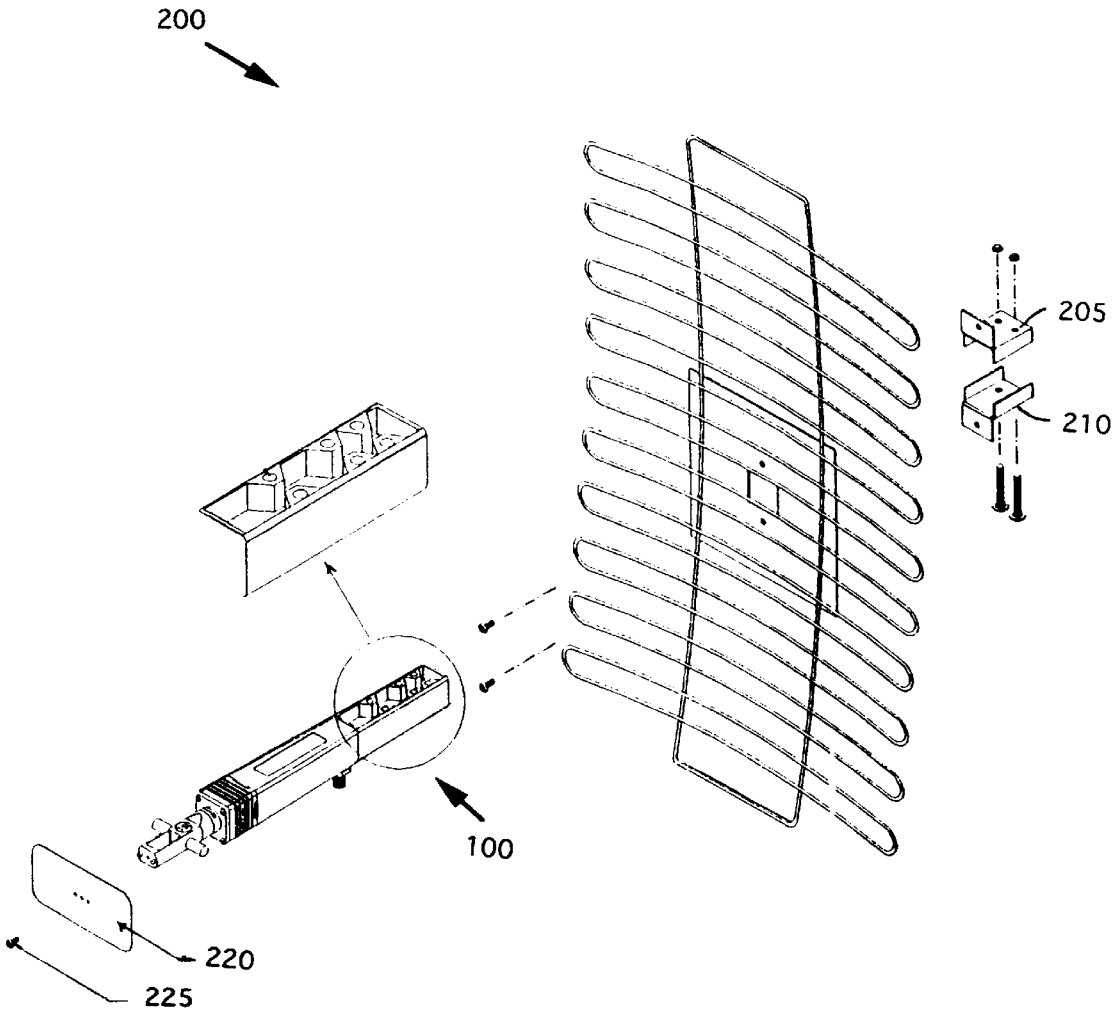
FIG. 2 is a perspective view for showing the mounting mechanism and structural features of a novel down converter of the present invention mounted onto an antenna reflector for operation as a single body system.
Figure 3:
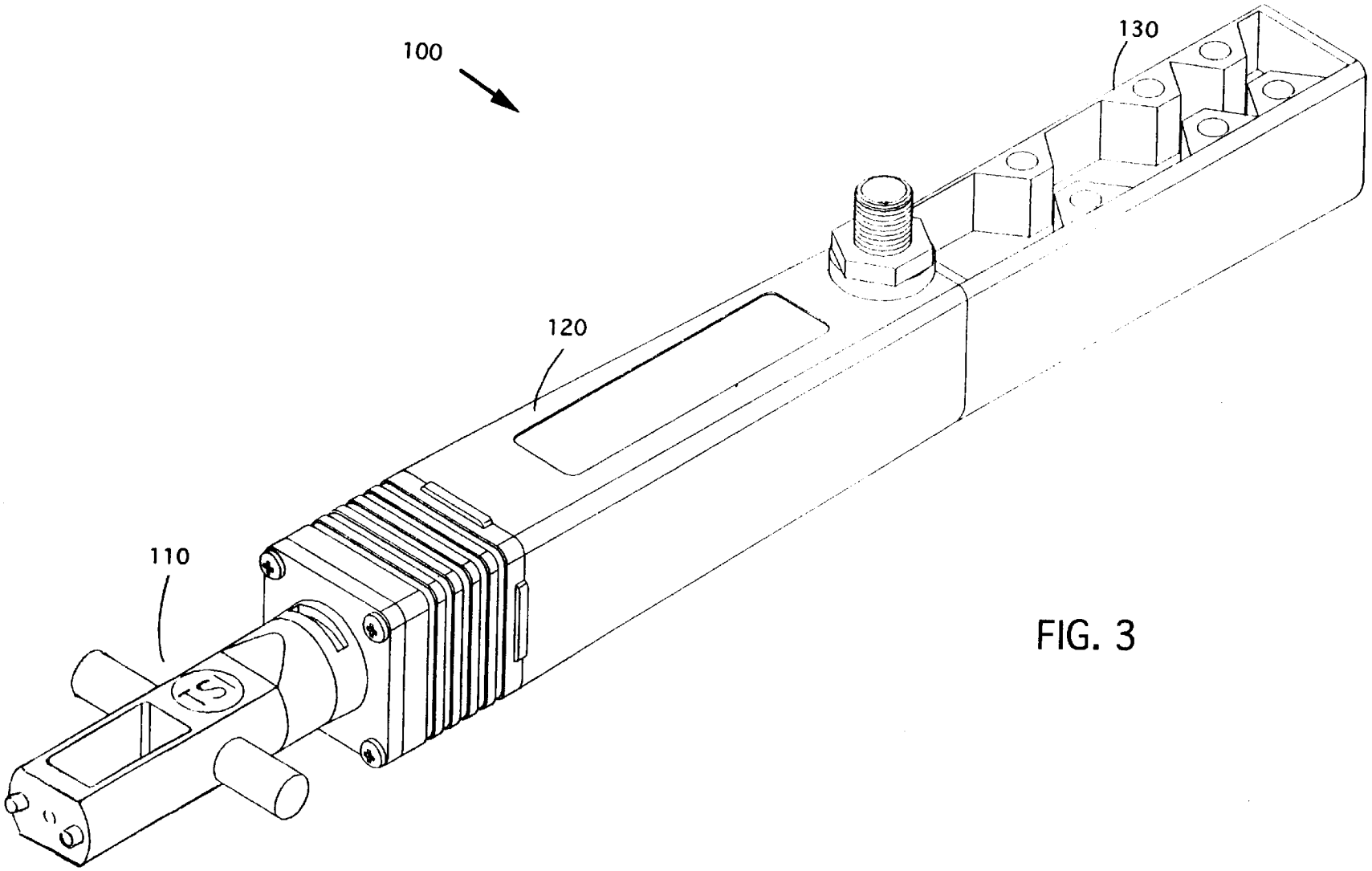
FIG. 3 shows a seamless housing structure of the down converter of this invention integrated with a dipole antenna mounted thereon as a top cover unit.

Referring to FIG. 2 for an overall perspective view showing the structural features of a novel integrated down converter-dipole antenna unit 100 of this invention implemented in an antenna reflector system 200. The integrated down converter-dipole antenna unit 100 is placed at a central focal area of the reflector antenna system 200 and mounted securely thereto with two mounting brackets 205 and 210. The antenna reflector system further includes a sub-reflector 220 attached to the integrated down converter-dipole antenna unit 100 by a mounting screw 225. Referring to FIG. 3 for a perspective view of an integrated down-converter and dipole antenna unit 100. This integrated unit 100 includes a dipole antenna 110, mounted onto a housing body containing a down converter 120 and a rear structural framework 130 which provides the mounting holes to fit the mounting brackets 205 and 210 to securely mount onto the antenna reflector system 200.

Figure 4:
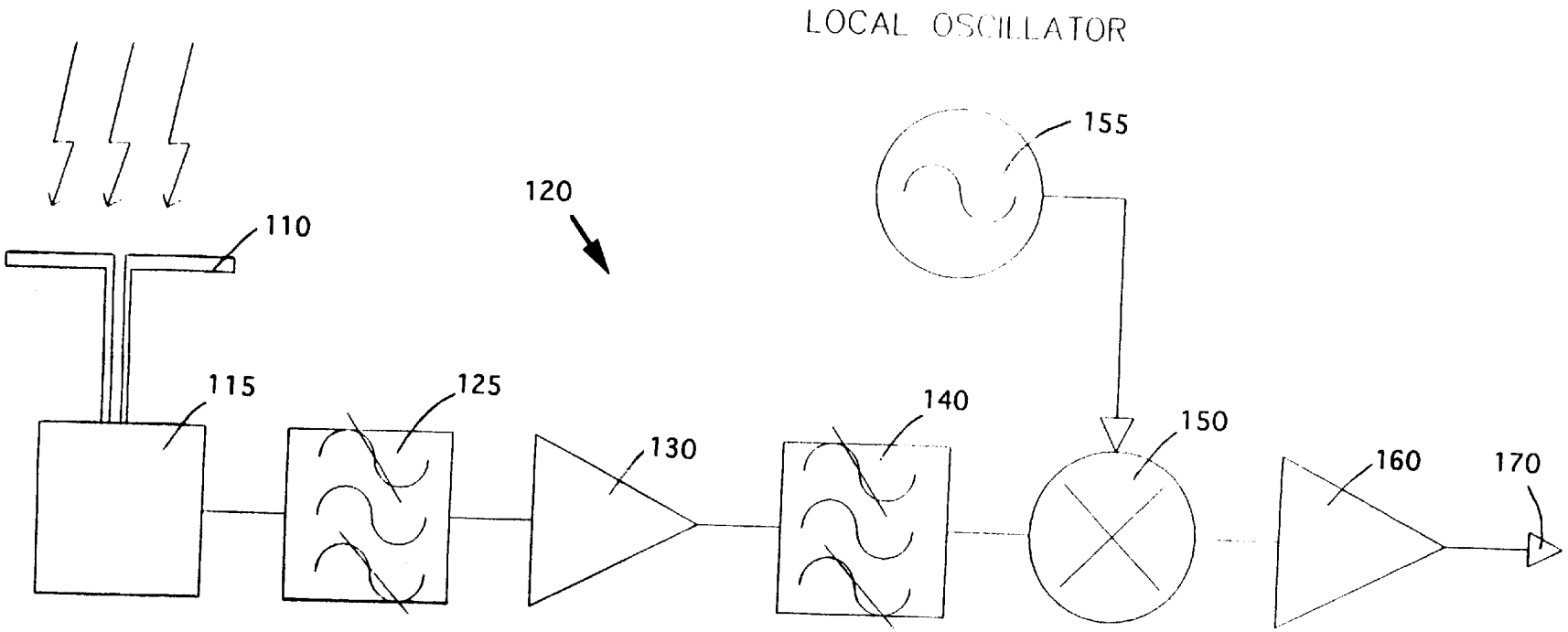
FIG. 4 is a functional block diagram for showing the flow of signal processing steps carried out by different components included in the down converter of the present invention.

Referring to FIG. 4 for a functional block diagram for illustrating different components included in the down converter 120. The television signal is first received by the dipole antenna 110 as balanced signals and transmitted to a balance-to-unbalance (BALUN) converter 115 to convert to an unbalanced signal. The unbalanced signals generated from the BALUN converter 115 are processed by a high frequency mechanical filter 125 wherein only signals suitable for television display are filtered through filters before such signals are amplified by a low noise amplifier 130. The amplified signals are then processed by a second stage filter, i.e., a high frequency semi-mechanical filter 140 to assure the unnecessary signals are filtered out such that the circuit elements at the later stages would not be damaged by random signals incidentally passing through. The filtered signal generated from the semi-mechanical filter 140 are entering into a mixer 150 for mixing with a high-precision high frequency signal generated from a local oscillator 155 where a frequency differential signal is generated for converting the high frequency to a UHF or VHF bandwidth. A phase lock loop is employed in the local oscillator 155 for generating a high precision high frequency signal. The UHF or VHF signals are processed by an intermediate frequency amplifier 160 and outputted from an F-type connector 170.

Figure 5:
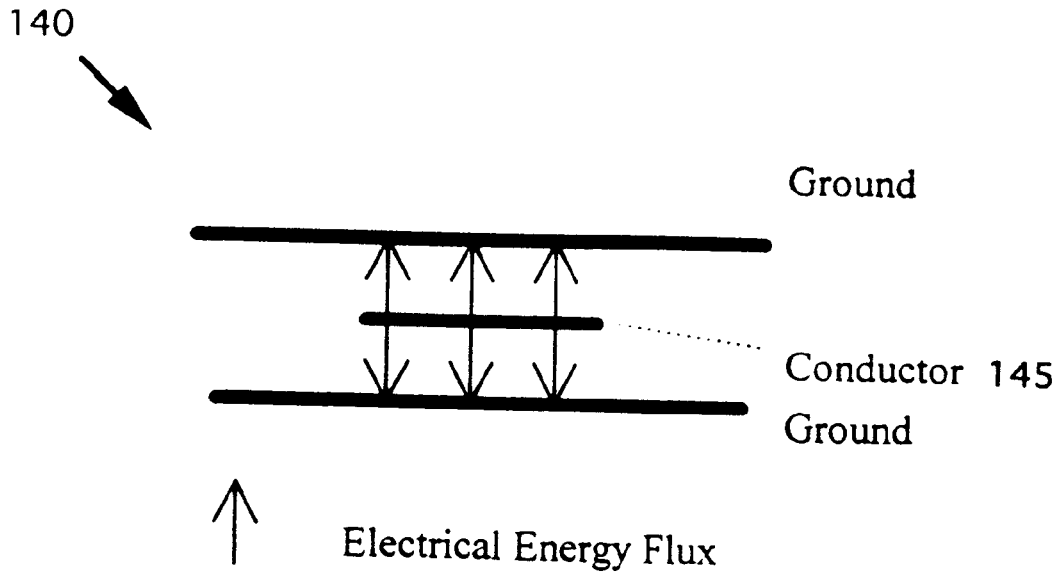
FIG. 5 is a functional diagram of the mechanical filter for illustrating functions carried out by several components of the mechanical filter according to the novel structure of this invention.

FIG. 5 is a functional diagram to illustrate the working principle of the semi-mechanical filter 140 implemented in the down converter 120. It is based on a comb line principle where the semi-mechanical filter 140 is formed with identical and symmetrical circuits. Therefore, the semi-mechanical filter 140 as disclosed in this invention provides the benefits that flexible and convenient tuning of the filtering characteristics are provided as will be further explained below. Furthermore, the semi-mechanical filter can be provided at a lower cost by making two symmetrically identical upper and lower printed circuit boards. By the use of the mechanical filter 125, the energy dissipation is minimized because the energy of the signals are stored and transmitted through the air. The difficulties encountered in the prior art are resolved. The application of mechanical filter to achieve high quality signal processing can be achieved without costly design and manufacture processes. Flexible tuning and adjustment of the filtering characteristics is also provided for both the mechanical filter 125 and the semi-mechanical filter 140.

Figure 6:
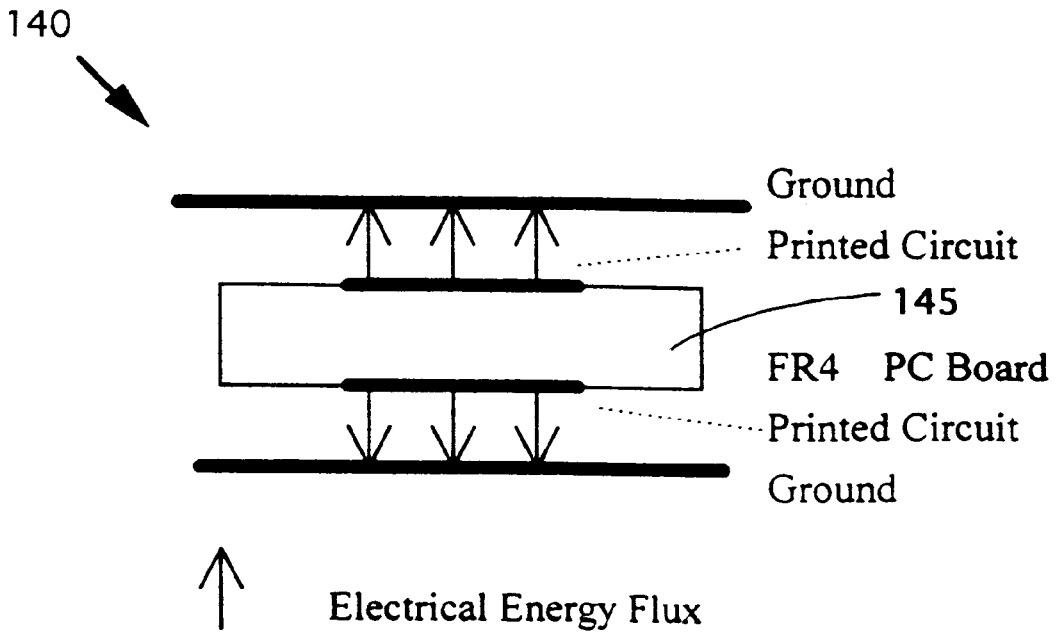
FIG. 6 is a functional diagram showing the structural features of a semi-mechanical filter of this invention and the functions performed by this filter.

FIG. 6 is a functional diagram to illustrate the working principle of the mechanical filter 140 implemented in the down converter 120. The semi-mechanical filter 140 is structured by placing the printed circuit board 145 in the center. The printed circuit board 145 is composed of FR4 board and a plurality of filter-circuits are printed on either sides of the board. The FR4 board would cause the signals to dissipate when transmitted through the board. The housing container is connected to a ground voltage. Symmetrical electrical fields between the upper and lower gaps between the board 140 and the housing container are generated. The energy of the signals would then be stored in the air of the upper and the lower gaps because of the symmetrical arrangement. Instead of dissipating through the PC board 140 as that occurred in a conventional down converter, the semi-mechanical filter 140 provides a high frequency filter which has a low signal dissipation characteristic just like a mechanical filter while the structure is very simple. Simple and convenient manufacture processes can be applied to assemble a semi-mechanical filter 140. A high frequency mechanical filter of high stability and low cost is therefore disclosed in this invention.

Figure 7:
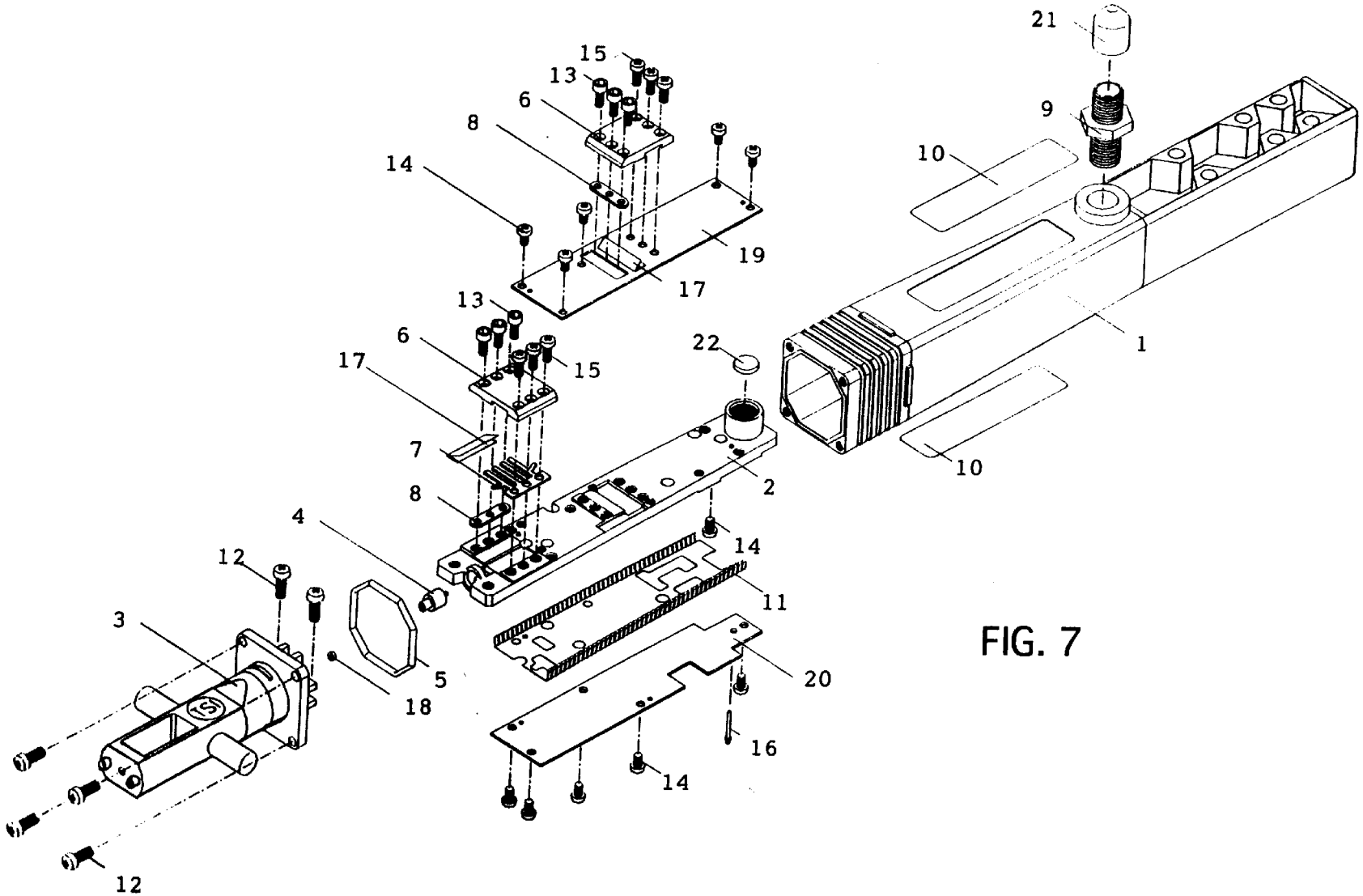
FIG. 7 is an explosive perspective view of the integrated down converter to show the seamless structure of the housing for containing and protecting the down converter and the leak proof lid integrated with the dipole antenna mounted thereon.

FIG. 7 is an explosive view to show the detail structure of the down converter 120. The down converter 120 is contained in a seamless housing 301. The down converter 120 is structured with a main plate 302, which receives incoming signals from a dipole antenna 110 via an N-CON pin 304. The dipole antenna 110 is securely attached to the seamless hosing 302 via four screws 312 via an O-ring 305 and the dipole antenna 110 is further locked to the down converter main plate 302 by two screws 312'. The incoming signals is first processed by a mechanical filter which includes a filtering conductor 307 disposed under a conductor cover 306 and above a tuning rubber 308. A piece of TEFLON 317 provides a spring cushion to the cover plate 306 for two sets of screws 13 and 15 to adjust the distance between the filtering conductor 307 and the top surface of the main plate 302. The filtering characteristics of the mechanical filter 125 are a function of the capacitance formed between the conductor 307 and the top surface of the main plate 302. And the capacitance C can be calculated by:

$$C=(\epsilon A)/d \tag{1}$$

where $\epsilon$ is the dielectric coefficient of the tuning rubber 308, A is the area of the filtering conductor 307 and d is the distance between the filtering conductor 307 and the top surface of the main plate 302. Therefore, by adjusting the screws 315 and 313, the distance d is changed and consequently the capacitance C is changed and the filtering characteristics of the mechanical filter 125 is tuned.

After the mechanical filter 125 with a structure described above filters the incoming signals, a low noise amplifier 130 is applied to amplify the filtered signals. The circuit details of the low noise filter 130 are well known in the art and not shown. As depicted in FIG. 6, these circuits are formed on the top assembly, e.g., a printed circuit board 319, and a bottom assembly, e.g. another printed circuit board 320 which includes circuits which are entirely identical to the circuit board 319. A semi-mechanical filter 140 is then employed to further filter the signal transmitted through. The semi-mechanical filter is structured based on the same principle as that described for the mechanical filter 125. The semi-mechanical filter 140 also includes a conductor cover 306' disposed over a tuning rubber 308' with a TEFLON 317 providing a spring function underneath. There is also a springboard 311 disposed between the main plate 302 and the printed circuit board 320. The capacitance of the semi-mechanical filter 140 which is a function of the distance from the upper and lower printed circuit boards 319 and 320 to the main plate 302 can therefore be adjusted to tune the filtering characteristics of the semi-mechanical filter 140.

According to FIG. 7 and above descriptions, the present invention discloses an integrated dipole antenna and down converter apparatus 100. The integrated dipole antenna and down converter apparatus 100 includes a dipole antenna 110 for receiving microwave signals therein. The integrated dipole antenna and down converter apparatus further includes a down converter 120 for receiving processed signals of the microwave signals from the dipole antenna 110 for converting the processed signals to signals of lower frequency. The down converter includes main plate 302 for supporting a tunable mechanical filter 125. The down converter further includes a tunable semi-mechanical filter 140 supported on the plate 302. The semi-mechanical filter 140 includes an upper circuit assembly 319 and an identically symmetrical lower circuit assembly 320 for canceling electromagnetic waves transmitting in the upper and lower circuit assemblies 319 and 320 and the main plate 302. Thus, the signal filtering efficiency is improved by reducing signal dissipation in the upper and lower circuit assemblies. In a preferred embodiment, the integrated dipole antenna and down converter apparatus 100 further includes a housing 301 for containing the down converter 120. The housing 302 and the upper and lower circuit assemblies 319 and 320 defining an upper and a lower space for storing energy of the electromagnetic waves therein thus reducing signal dissipation in the upper and lower circuit assemblies. In another preferred embodiment, the semi-mechanical filter 140 further includes a capacitance tuning means, which includes a distance adjusting means, e.g., a set of four screws 313, 314, and 315. The capacitance tuning means further includes rubber tuning means 308' and TEFLON spring means 311 for allowing flexible adjustment of a distance from the upper circuit assembly 319 and the bottom circuit assembly 320 to the surface of the container housing 301. Flexible tuning of the capacitance of the semi-mechanical filter 140 can be achieved by adjusting the screws 313 to 315 by to adjust the distance between the top and bottom printed circuit boards 319 and 320 and the seamless housing container 301.

In summary this invention discloses a down converter supported on a main plate and contained in a housing. The down converter includes a tunable semi-mechanical filter supported on the plate. The semi-mechanical filter includes an upper circuit assembly and an identically symmetrical lower circuit assembly for canceling electromagnetic waves transmitting in the upper and lower circuit assemblies and the main plate whereby signal filtering efficiency is improved by reducing signal dissipation in the upper and lower circuit assemblies. In a preferred embodiment, the housing provides a ground potential. And, the semi-mechanical filter further includes a capacitance tuning means for adjusting a capacitance between the semi-mechanical filter and the housing. In another preferred embodiment, the capacitance adjusting means is a distance adjusting means for adjusting a distance from the upper circuit assembly and the lower circuit assembly to the housing.

This invention also discloses a method for configuring a down converter supported on a main plate and contained in a housing. The method includes a step of attaching a tunable semi-mechanical filter on the plate by providing to the semi-mechanical filter an upper circuit assembly and an identically symmetrical lower circuit assembly. The upper circuit assembly and the identically symmetrical lower circuit assembly are for canceling electromagnetic waves transmitting in the upper and lower circuit assemblies and the main plate for improving a signal filtering efficiency by reducing signal dissipation in the upper and lower circuit assemblies.

Figure 8A:
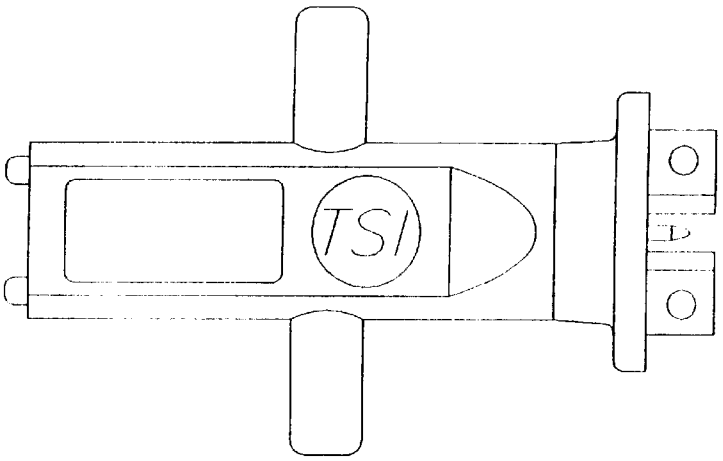
FIGS. 8A and 8B are two cross sectional views showing the relative position and the structure of the improved dipole antenna of the present invention.
Figure 8B:
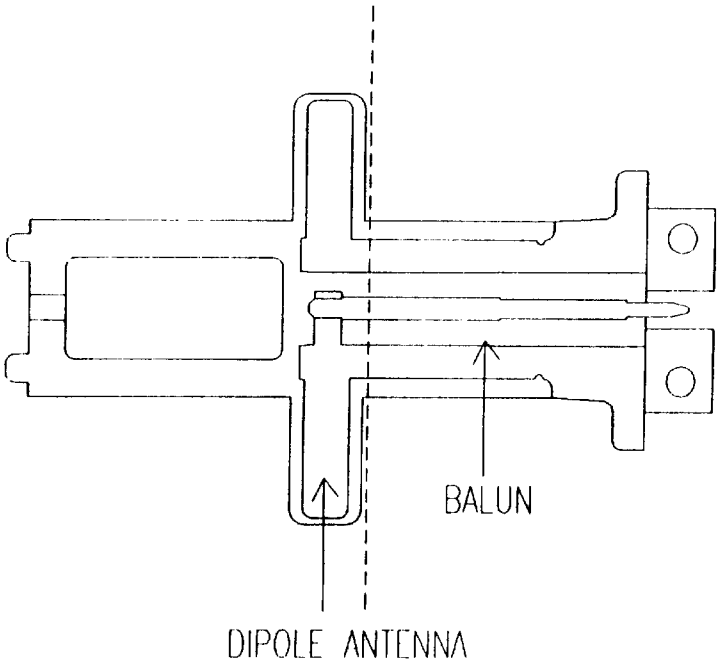

Referring to FIGS. 8A and 8B for two cross sectional views of the dipole antenna 110. The dipole antenna receives the electromagnetic waves. The signals received are balanced signals. The balanced signal is processed by a balance-unbalance (BALUN) converter to converter the balanced signal into unbalanced signals. Since the structure and principle of operations are well known in the art, additional detailed descriptions are not necessary for the purpose of describing the main features of this invention.

This invention therefore discloses a method for configuring an integrated dipole antenna and down converter apparatus. The method includes the steps of: a) attaching a dipole antenna to a down converter for receiving microwave signals; b) receiving processed signals of the microwave signals from the dipole antenna to the down converter supported on a main plate for converting the processed signals to signals of lower frequency; c) providing to the down converter a tunable semi-mechanical filter by attaching an upper circuit assembly and an identically symmetrical lower circuit assembly to the main plate for canceling electromagnetic waves transmitting in the upper and lower circuit assemblies and the main plate for improving a signal filtering efficiency by reducing signal dissipation in the upper and lower circuit assemblies. In a preferred embodiment, the method further includes a step of providing a housing for containing the down converter and for employing the housing and the upper and lower circuit assemblies for defining an upper and a lower space for storing energy of the electromagnetic waves therein thus reducing signal dissipation in the upper and lower circuit assemblies. In a preferred embodiment, the step c) of providing a tunable semi-mechanical filter by attaching the upper circuit assembly and the identically symmetrical lower circuit assembly to the main plate is a step of providing a capacitance tuning means for adjusting a capacitance between the semi-mechanical filter and the housing. In another preferred embodiment, the step of providing a capacitance adjusting means is a step of providing a distance adjusting means for adjusting a distance from the upper circuit assembly and the lower circuit assembly to the housing. In yet another preferred embodiment, the step of providing a distance adjusting means further includes a step of providing a set of attaching means. And, the step of providing a distance adjusting means further includes placing a top flexible dielectric buffer means between upper circuit assembly and the main plate, and placing a bottom flexible dielectric buffer means between the lower circuit assembly and the main plate. And, the step of providing a distance adjusting means further includes a step of adjusting the attaching means for attaching the upper circuit assembly and lower circuit assembly to the main plate. Thus, a distance of the distance from the upper circuit assembly and the lower circuit assembly to the housing can be flexibly adjusted. In another preferred embodiment, the step of placing a top flexible dielectric buffer means between upper circuit assembly and the main plate is a step of placing a rubber tuning means. And, the step of placing a bottom flexible dielectric buffer means between the lower circuit assembly and the main plate is a step of placing a TEFLON spring function for flexibly adjusting a distance between the upper circuit assembly and the lower circuit assembly to the housing.

Therefore, the present invention provides a novel down converter structure and signal processing configuration combining a mechanical filter and a semi-mechanical filter. The performance characteristics of the down converter can be conveniently controlled with flexible fining tuning process in the manufacturing processes whereby the difficulties and limitations in the prior art can be overcome. Specifically, adjustment of the filtering characteristics of the mechanical and semi-mechanical filters can be conveniently carried out for fine tuning these filters whereby a timing consuming process by applying iterative trial-and-error manufacture procedures can be circumvented. A simplified housing assembly is provided to contain the mechanical and semi-mechanical filters therein with seamless body composed of casting aluminum sealed with a single leak proof lid such that total waterproof of the dipole antenna-down converter is assured to provide reliable long term outdoor operation. By integrating the down converter with an improved dipole antenna and a balance-unbalance converter, the dipole antenna is manufactured with higher water resistivity and structural integrity while providing high bandwidth performance characteristics between a bandwidth ranging from 2 GHz to 3 GHz. Low signal dissipation is achieved and high stability of signal conversion is continuously performed such that a down converter of high efficiency and high stability manufactured with simplified procedures at lower cost than conventional down converter with mechanical filter is provided. The semi-mechanical filter is constructed with symmetrical structure including the circuits printed on both sides of the printed circuit board. The semi-mechanical filter performs as a true mechanical filter without being affected by the signal dissipation when transmitting in the printed circuit board and further the semi-mechanical filter is manufactured without requiring a soldering operation commonly employed in a conventional structure when a mechanical filter is employed.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An integrated dipole antenna and down converter apparatus comprising:

a dipole antenna for receiving microwave signals therein;

a down converter for receiving processed signals of said microwave signals from said dipole antenna for converting said processed signals to signals of lower frequency;

said down converter includes main plate for supporting a tunable mechanical filter; and said down converter further includes a tunable semi-mechanical filter supported on said plate wherein said semi-mechanical filter includes an upper circuit assembly and an identically symmetrical lower circuit assembly for canceling electromagnetic waves transmitting in said upper and lower circuit assemblies and said main plate whereby signal filtering efficiency is improved by reducing signal dissipation in said upper and lower circuit assemblies.

2. The integrated dipole antenna and down converter apparatus of claim 1 further comprising:

a housing for containing said down converter, wherein said housing and said upper and lower circuit assemblies defining an upper and a lower space for storing energy of said electromagnetic waves therein thus reducing signal dissipation in said upper and lower circuit assemblies.

3. The integrated dipole antenna and down converter apparatus of claim 1 wherein:

said semi-mechanical filter further includes a capacitance tuning means for adjusting a capacitance between said semi-mechanical filter and said housing.

4. The integrated dipole antenna and down converter apparatus of claim 3 wherein:

said capacitance adjusting means is a distance adjusting means for adjusting a distance from said upper circuit assembly and said lower circuit assembly to said housing.

5. The integrated dipole antenna and down converter apparatus of claim 4 wherein:

said distance adjusting means further includes a set of attaching means and a top flexible dielectric buffer means disposed between upper circuit assembly and said main plate and a bottom flexible dielectric buffer means disposed between said lower circuit assembly and said main plate wherein said attaching means adjusting an attachment of said upper circuit assembly and lower circuit assembly to said main plate thus adjusting a distance of said distance from said upper circuit assembly and said lower circuit assembly to said housing.

6. The integrated dipole antenna and down converter apparatus of claim 5 wherein:

said set of attaching means and a top flexible dielectric buffer means are a set of screws for attaching said upper and lower circuit assemblies to said main plate.

7. The integrated dipole antenna and down converter apparatus of claim 5 wherein:

said top flexible dielectric buffer means includes a rubber tuning means and said bottom flexible dielectric buffer means includes a spring function means provided for flexible adjusting a distance between said upper circuit assembly and said lower circuit assembly to said housing.

8. A down converter supported on a main plate and contained in a housing comprising:

a tunable semi-mechanical filter supported on said plate wherein said semi-mechanical filter includes an upper circuit assembly and an identically symmetrical lower circuit assembly for canceling electromagnetic waves transmitting in said upper and lower circuit assemblies and said main plate whereby signal filtering efficiency is improved by reducing signal dissipation in said upper and lower circuit assemblies.

9. The down converter of claim 8 wherein:

said housing providing a ground potential; and said semi-mechanical filter further includes a capacitance tuning means for adjusting a capacitance between said semi-mechanical filter and said housing.

10. The down converter of claim 9 wherein:

said capacitance adjusting means is a distance adjusting means for adjusting a distance from said upper circuit assembly and said lower circuit assembly to said housing.

11. The down converter of claim 10 wherein:

said distance adjusting means further includes a set of attaching means and a top flexible dielectric buffer means disposed between upper circuit assembly and said main plate and a bottom flexible dielectric buffer means disposed between said lower circuit assembly and said main plate wherein said attaching means adjusting an attachment of said upper circuit assembly and lower circuit assembly to said main plate thus adjusting a distance of said distance from said upper circuit assembly and said lower circuit assembly to said housing.

12. The down converter of claim 11 wherein:

said set of attaching means and a top flexible dielectric buffer means are a set of screws for attaching said upper and lower circuit assemblies to said main plate.

13. The down converter of claim 11 wherein:

said top flexible dielectric buffer means includes a rubber tuning means and said bottom flexible dielectric buffer means includes a spring function means provided for flexible adjusting a distance between said upper circuit assembly and said lower circuit assembly to said housing.

14. A method for configuring a down converter supported on a main plate and contained in a housing comprising a step of:

attaching a tunable semi-mechanical filter on said plate by providing to said semi-mechanical filter an upper circuit assembly and an identically symmetrical lower circuit assembly for canceling electromagnetic waves transmitting in said upper and lower circuit assemblies and said main plate for improving a signal filtering efficiency by reducing signal dissipation in said upper and lower circuit assemblies.

15. A method for configuring an integrated dipole antenna and down converter apparatus comprising steps of:

a) attaching a dipole antenna to a down converter for receiving microwave signals;

b) receiving processed signals of said microwave signals from said dipole antenna to said down converter supported on a main plate for converting said processed signals to signals of lower frequency;

c) providing to said down converter a tunable semi-mechanical filter by attaching an upper circuit assembly and an identically symmetrical lower circuit assembly to said main plate for canceling electromagnetic waves transmitting in said upper and lower circuit assemblies and said main plate for improving a signal filtering efficiency by reducing signal dissipation in said upper and lower circuit assemblies.

16. The method of claim 15 further comprising a step of:

providing a housing for containing said down converter and for employing said housing and said upper and lower circuit assemblies for defining an upper and a lower space for storing energy of said electromagnetic waves therein thus reducing signal dissipation in said upper and lower circuit assemblies.

17. The method of claim 15 wherein:

said step c) of providing a tunable semi-mechanical filter by attaching said upper circuit assembly and said identically symmetrical lower circuit assembly to said main plate is a step of providing a capacitance tuning means for adjusting a capacitance between said semi-mechanical filter and said housing.

18. The method of claim 17 wherein:

said step of providing a capacitance adjusting means is a step of providing a distance adjusting means for adjusting a distance from said upper circuit assembly and said lower circuit assembly to said housing.

19. The method of claim 18 wherein:

said step of providing a distance adjusting means further includes a step of providing a set of attaching means;

said step of providing a distance adjusting means further includes placing a top flexible dielectric buffer means between upper circuit assembly and said main plate, and placing a bottom flexible dielectric buffer means between said lower circuit assembly and said main plate; and said step of providing a distance adjusting means further includes a step of adjusting said attaching means for attaching said upper circuit assembly and lower circuit assembly to said main plate thus adjusting a distance of said distance from said upper circuit assembly and said lower circuit assembly to said housing.

20. The method of claim 19 wherein:

said step of adjusting said attaching means for attaching said upper circuit assembly and lower circuit assembly to said main plate is a step of employing a set of screws for attaching said upper and lower circuit assemblies to said main plate.

21. The method of claim 19 wherein:

said step of placing a top flexible dielectric buffer means between upper circuit assembly and said main plate is a step of placing a rubber tuning means; and said step of placing a bottom flexible dielectric buffer means between said lower circuit assembly and said main plate is a step of placing a spring function for flexibly adjusting a distance between said upper circuit assembly and said lower circuit assembly to said housing.

* * * * *